United States Patent [19]

Carroll et al.

[11] 4,370,635

[45] Jan. 25, 1983

[54] UNDERVOLTAGE RELEASE DEVICE FOR A CIRCUIT BREAKER

[75] Inventors: John T. Carroll, Cary, N.C.; Miguel B. Yamat, Franklin, Wis.

[73] Assignee: Siemens-Allis, Inc., Atlanta, Ga.

[21] Appl. No.: 191,535

[22] Filed: Sep. 29, 1980

[51] Int. Cl.[3] ..... H01H 73/00; H01H 83/00

[52] U.S. Cl. ..... 335/20; 200/153 SC

[58] Field of Search ..... 335/20, 73; 200/153 SC

[56] References Cited

U.S. PATENT DOCUMENTS

| | | | |
|---|---|---|---|
| 3,919,674 | 11/1975 | Acampora et al. | 335/20 |
| 4,020,432 | 4/1977 | Erickson et al. | 335/73 |
| 4,110,582 | 8/1978 | Barkan | 200/153 SC |
| 4,180,788 | 12/1979 | Barkan | 335/73 |
| 4,301,434 | 11/1981 | Castonquay | 335/20 |

*Primary Examiner*—Harold Broome

*Attorney, Agent, or Firm*—Frederick W. Powers, III

[57] ABSTRACT

A direct acting undervoltage release device utilizes stored spring energy to trip a circuit breaker when the control voltage reduces to a critical level (the "undervoltage"). The device includes a solenoid that senses the undervoltage, and a charging motor that automatically resets the device after a tripping operation (provided the control voltage recovers to its normal level). The direct acting feature is achieved by providing a chargable trip spring and a trip pin in the circuit breaker which directly drives the latch bar of the breaker to trip the breaker.

25 Claims, 7 Drawing Figures

UNDERVOLTAGE RELEASE DEVICE FOR A CIRCUIT BREAKER

BACKGROUND OF THE INVENTION

1. Field of the Invention

This invention relates to an undervoltage release device for a circuit breaker. In particular, this invention relates to an undervoltage release device for a circuit breaker which is actuated by a trip coil. Still more particularly, this invention relates to an undervoltage release device for a circuit breaker which incorporates an electromagnetic device for sensing the undervoltage condition of a control voltage, and a chargeable trip spring for tripping the circuit breaker by means of the energy stored in the trip spring.

2. Description of the Prior Art

An undervoltage release device for a circuit breaker has the task of tripping the circuit breaker when the voltage under control or control voltage is reduced to a critical level. For this purpose, a circuit breaker is conventionally equipped with a normal trip coil.

In some presently known circuit breakers, electromagnetic sensing devices such as solenoids are used for sensing of the undervoltage condition of the control voltage. It is also known to trip a circuit breaker by means of energy stored in a charged spring.

In another presently known version of a circuit breaker, the undervoltage condition is sensed through a capacitor-relay system which energizes the trip coil of the circuit breaker. In such an approach, the aging of the capacitor has to be taken into consideration. The capacitor has only a definite life time, and therefore, the undervoltage release device of the circuit breaker has only a limited reliability. It is, however, an important objective in this technical field to design long-lasting tripping mechanisms for circuit breakers.

In some presently known circuit breakers, there may be a hazard that the circuit breaker is not tripped when the control voltage suddenly reduces to or below a critical value at which the normal trip coil of the circuit breaker does no longer activate. This means loss of control of the circuit breaker which is a great disadvantage especially as short circuit conditions.

It has to be understood, therefore, that the undervoltage release device should also perform a switching operation when the control voltage reduces to and below a critical voltage level at which the normal trip coil of the circuit breaker does not activate.

SUMMARY OF THE INVENTION

1. Objects

It is an object of this invention to provide an undervoltage release device for a circuit breaker which is adapted to trip the circuit breaker when the control voltage reduces to a critical value at and below which the normal trip coil of the circuit breaker does not activate.

It is another object of this invention to provide an undervoltage release device for a circuit breaker that is activated even at short circuit conditions.

It is still another object of this invention to provide an undervoltage release device for a circuit breaker which includes a spring charging mechanism and a latching mechanism for latching the spring charging mechanism, whereby these mechanisms directly act upon each other and a latch bar of the circuit breaker in a tripping operation.

It is still another object of this invention to provide an undervoltage release device for a circuit breaker, the control box of which may be conveniently located and isolated from the circuit breaker mechanism.

It is still another object of this invention to provide an undervoltage release device for a circuit breaker which includes a spring charging mechanism and which automatically resets the charging mechanism independently of the circuit breaker mechanism after a tripping operation.

It is still another object of this invention to provide an undervoltage release device for a circuit breaker which may be used on a DC or AC system.

2. Summary

According to this invention, an undervoltage release device for a trip coil actuated circuit breaker incorporates a solenoid for sensing an undervoltage, and a chargeable trip spring for storing energy and for discharging the stored energy and thereby tripping the circuit breaker. The trip spring is preferably a helical spring. The solenoid contains a plunger which is movable between an attracted position and a released position. The solenoid exercises a holding force to the plunger when it is energized by a control voltage.

The undervoltage release device further incorporates an electric charging motor and a driving device. The driving device which is operatively connected to the charging motor and to the trip spring, is used for precharging the trip spring. In operation, the driving device moves from an initial or tripped position to a stand-by position.

A blocking device is provided for stopping and holding the driving device in the stand-by position.

The undervoltage release device further incorporates a coil spring. One end of the coil spring is operatively connected to the plunger of the solenoid, and the other end of the coil spring is operatively connected to the driving device. The driving device applies a charging force to the coil spring in counteraction to the holding force of the plunger, when the driving device is in its stand-by position. The plunger is in its attracted position when the control voltage to be supervised has a normal voltage value and, therefore, the holding force of the solenoid is greater than the charging force of the coil spring. The plunger is in its released position when the holding force is smaller than the charging force. This will occur when the control voltage is an undervoltage, that is, drops below a predetermined threshold value.

The undervoltage release device finally incorporates a releasing device which is actuated by the plunger. This releasing device will act upon the locking device and thereby release the driving device out of its stand-by position, when the holding force of the plunger decreases in case of an undervoltage and the plunger therefore moves from its attracted position into its released position.

In the undervoltage release device according to the invention, the energy stored in the charged trip spring is used for tripping the circuit breaker. The trip spring may actuate a trip pin which in turn releases the main latch bar of the circuit breaker.

A flexible cable can be used between the trip pin and the trip spring on the one hand and the control box of the undervoltage release device on the other hand for triggering the charged trip spring.

The driving device may preferably include a crank drive which acts upon a pivot drive for charging the coil spring. The pivot drive in turn may actuate an electric switch which turns off the charging motor when the stand-by position is reached. The blocking device may simply be a latch or cam associated with the pivot drive. The releasing device may be a latch lever assembly which is actuated by the plunger. The pivot drive and the latch lever as well as the crank drive are preferably rotatable about axes which are parallel to each other. The pivot drive and latch lever may have the same axis of rotation.

The foregoing and other objects, features and advantages of the invention will be apparent from the following more particular description of preferred embodiments of the invention, as illustrated in the accompanying drawings.

DETAILED DESCRIPTION OF THE PREFERRED EMBODIMENTS

Figure 1:
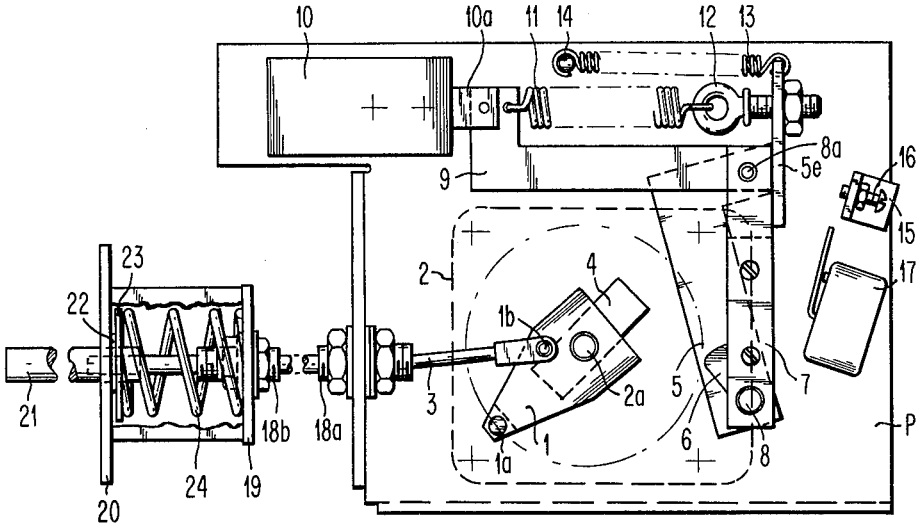
FIG. 1 is a top or planar view of an undervoltage release device for a circuit breaker in its tripped position with the trip coil discharged.

With reference to FIGS. 1 through 4, the undervoltage release device for a circuit breaker contains an armature 1 which is a plate essentially of V-shape. As will become apparent later, the armature 1 is the eccentric lever or crank arm of a crank drive. It is the essential part of a driving device. The upper or acuate portion of the armature 1 contains a recess, see FIG. 3, and a first pin 1*a* projects through the recess. The armature 1 is rotatable about an axis which is located in its lowr or broader portion. In a distance e aside from the connection line between the axis of rotation and the first pin 1*a* is located a second pin 1*b*. The distance e characterizes the eccentricity of the crank arm or armature 1. Both pins 1*a* and 1*b* are parallel to each other and to the axis of rotation. The axis of rotation is formed by the driving or motor shaft 2*a* of a motor 2. The motor 2 is connected to a ground or base plate P which is part of a box. The armature 1 is pivotly connected to the shaft 2*a*.

The second pin 1*b* is used as a connection point for a flexible push-pull cable 3.

Below the armature 1 is provided a drive bar 4. This drive bar 4 is firmly connected to the shaft 2*a*. The distance between the connecting point and the outer end of the drive bar 4 is greater than the distance between the shaft 2*a* and the second armature pin 1*b*. In operation, the rotating drive bar 4 will pick up the armature 1 and rotate it about the shaft axis 2*a*.

The undervoltage release device also contains a swinging lever or a lever 5 which is L-shaped. The "L" has a smaller bottom portion and a longer main portion. The end face on the bottom portion of this lever 5 is arranged obliquely with respect to the longitudinal axis of the main portion. An end plate 5*e* is firmly secured to the oblique end face. The lever 5 is part of a pivot drive for charging a coil spring, as will be apparent later. It is also part of a blocking device.

Of great importance to the operation of the undervoltage release device is a cam or latch 6 which extends into the direction of the motor shaft 2*a* from a latch lever 7. The latch 6 is part of a releasing device, as will be explained later. The latch lever 7 is an elongated rectangular bar which is rotatable about a pivot 8. The pivoting point is located at the lower end. The pivot 8 is parallel to the shaft 2*a*. The end portion of the main part of the lever 5 is also pivotally connected to the pivot 8. Secured to the upper end of the latch lever 7 is a smaller pivot 8*a*. Pivotally connected to this pivot 8*a* is another lever 9 which is also of L-shape. If the shorter bottom portion of the lever 9 is moved from left to right in FIG. 2, the lever 9 will pivot about the pivoting point 8*a* which in turn will pivot about the pivoting point 8.

An electromagnet or solenoid 10 is firmly secured to the base plate P. The solenoid 10 is supplied by the control voltage to be monitored. A plunger 10*a* extends from the solenoid 10 perpendicularly to the motor shaft 2*a*. The outer end of the plunger 10*a* is pivotally connected to the smaller bottom portion of the L-shaped lever 9.

Also connected to the smaller bottom portion of the lever 9 is one end of a helical or coil spring 11. The coil spring 11 will exercise a certain spring force F1 to the plunger 10*a* in counter action to the holding force F4 of the plunger 10*a*. The plunger 10*a* is in an attracted or left position when the control voltage has a normal voltage value and when the holding force F4 of the solenoid 10 is therefore greater than the charging force F1 of the coil spring 11. The plunger 10*a* is in a released or right position when the holding force F4 is smaller than the charging force F1. The other end of the coil spring 11 is connected to an ear or loop 12 which is secured by a lead screw and a nut in the upper part of the lever end plate 5*e*.

A return spring 13 is provided close to the spring coil 11. One end of this return spring 13 is secured to a connecting point 14 in the base plate P, and the other end is hooked into an opening provided close to the upper end of the end plate 5*e*. The return spring 13, which is also illustrated as a coil spring, exercises a return spring force F2 to the end plate 5*e* and thereby to the levers 5, 7 and 9 and the solenoid plunger 10*a*.

Secured to the base plate P is a bracket 15. The upper portion of this bracket 15 contains an adjustable stop screw 16. In the charged position (see FIG. 2), the end plate 5*e* engages the tip of the screw 16. In this position, the lower part of the end plate 5*e* engages and depresses the switching arm of an electrical switch 17. This switch 17 is also secured on the ground plate P. The switch 17 is connected electrically to the motor 2 as is described below in connection with FIGS. 6 and 7. When the end plate 5*e* is in its right position, as shown in FIG. 2, the electric circuit for supplying the motor 2 is interrupted.

Figure 2:
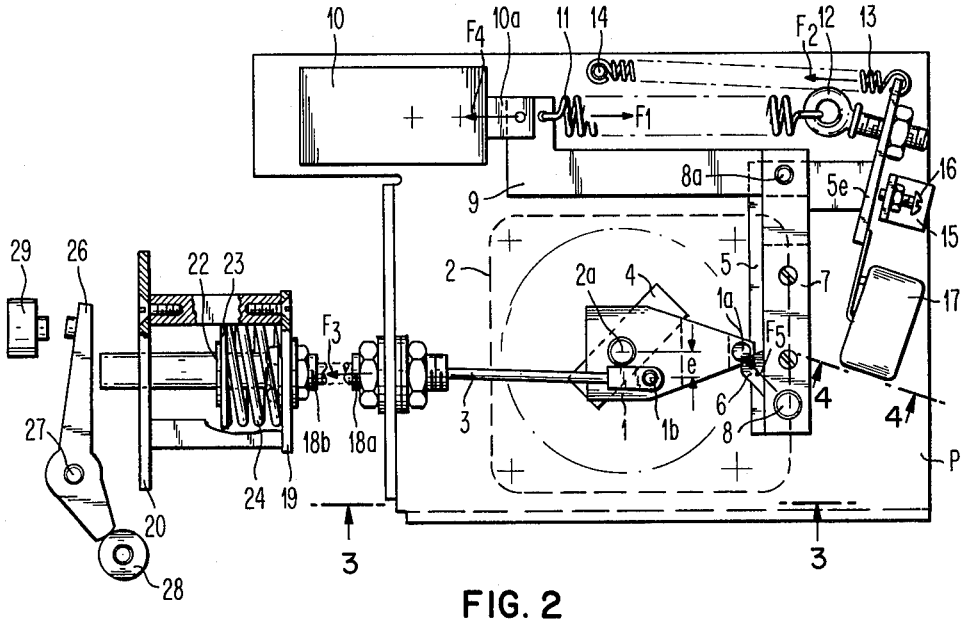
FIG. 2 is a top or planar view of the undervoltage release device of FIG. 1 in its charged position with the trip coil charged.
Figure 3:
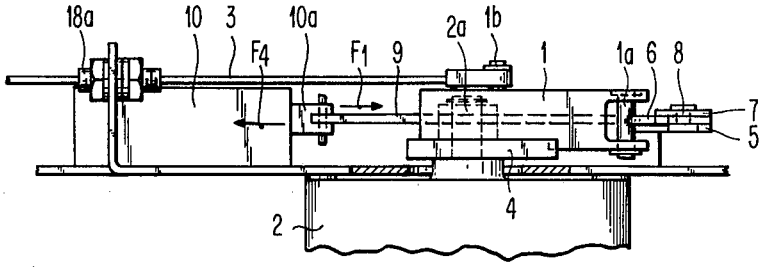
FIG. 3 is a side view of the undervoltage release device of FIG. 2 along line 3—3'.
Figure 4:
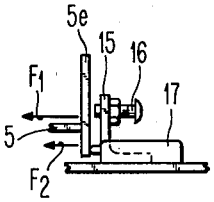
FIG. 4 is a side view of the undervoltage release device of FIG. 2 along line 4—4'.

As illustrated in FIGS. 1 and 2, the driving and release mechanism (illustrated on the right side) is connected to the trip coil device (illustrated on the left side) by means of the flexible cable 3. This cable 3 is guided through a bushing or jacket 18*a* out of a side wall of the control box. The bushing 18*a* is secured to the side wall by means of a lead screw and two nuts. A similar bushing or jacket 18*b* is also provided on the side of the trip coil device.

The trip coil device contains two mounting plates 19 and 20 which are arranged and fixed parallel to each other. Contained in the space between the mounting plates 19, 20 is a trip pin 21 which is aligned with the bushing 18*b*. The trip pin 21 has secured thereon an annular retainer leaf spring 22 which engages an end ring 23. Between the end ring 23 and the mounting plate 19 is arranged a chargeable trip spring 24. The trip spring 24 is shown to be a coil spring. By means of the flexible cable 3, the trip spring 24 can be transferred from a discharged position (as shown in FIG. 1) to a charged position (as shown in FIG. 2), and vice-versa. The trip spring force is denoted as F3. The outer end of the trip pin 21 is positioned close to the normal trip or latch bar 26 of the circuit breaker, as can be seen in FIG. 2. The latch bar 26 is rotatable about an axis 27. The latch roller of a four-bar linkage of the circuit breaker is denoted as 28.

The latch 6 exerts a latch force F5 the armature pin 1*a* in the charged position, as illustrated in FIG. 2.

Thus, the illustrated direct acting undervoltage release device utilizes as its main parts an electromagnet or a solenoid 10 that senses an undervoltage, a trip spring 24 that stores energy in order to trip the circuit breaker at undervoltage conditions, a release mechanism 6–9 that actuates the trip spring 24, and a charging motor 2 and a lever assembly that automatically resets the undervoltage release device after a tripping operation has taken place, provided the control voltage recovers its normal value.

A direct acting feature is herein achieved by letting the trip pin 21 directly drive the latch or latch bar 26 of the circuit breaker in order to trip the circuit breaker.

As indicated above, the tripping force F3 is supplied by the charged trip spring 24. This charged trip spring 24 may be located in the circuit breaker together with the trip pin 21 directly and parallel with the regular trip solenoid 29 of the circuit breaker by means of the mount-into plates 19 and 20.

The operation of the undervoltage device will now be explained. In the trip position, as illustrated in FIG. 1, where the trip spring 24 is discharged, the motor 2 is energized through a suitable electric source (not shown) via the switch 27. This causes the drive bar 4 (which is locked to the motor shaft 2*a* to pick up the armature 1 in a clockwise rotation. As the armature 1 turns, its second pin 1*b* pulls the flexible cable 3. This compresses and thereby charges the trip spring 24. This retracts the trip pin 21 away from the latch bar 26 of the circuit breaker.

During the same rotation of the armature 1, the first armature pin 1*a* pushes the lever 5 to the right to charge the coil spring 11, thereby counteracting the solenoid holding force F4 on the plunger 10*a*.

When the cable 4 crosses over the center line of the motor shaft 2, the torque applied on the armature 1 by the charged trip spring 24 reverses in direction (toggle action).

This causes the armature 1 to rotate freely, that is independently of the motor 2, until its first pin 1*a* rests on the latch lever 7. The lever 5 activates the switch 17 just when toggle occurs in order to de-energize the motor 2. Thereby an overdrive against the latch lever 7 is prevented.

Figure 5:
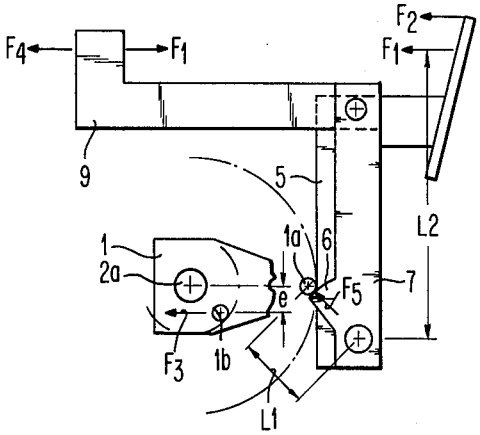
FIG. 5 is a schematic diagram of the lever assembly of the undervoltage release device of FIG. 2 in its charged position, illustrating various control forces.

The surface of the latch 6 is concentric with the pivot 8 so that the line of action of the latch force F5 passes through the center of the pivot 8 avoiding stray torque on the lever 7. The effect of any stray torque on the latch 6 caused by an impact between the first pin 1*a* and the latch 6 and shock-force from breaker operation is minimized by means of a large mechanical advantage L2/L1, as can be seen in the schematic diagram of forces in FIG. 5. L1 is the radius of the surface of the latch 6 with respect to the pivot 8, and L2 is the effective distance of the spring force F1 with respect to the pivot 8.

When the control voltage has a normal value, the holding force F4 of the solenoid 10 is greater than the charging force F1. The holding force F4 of the solenoid 10 decreases with the control voltage. When the spring force F1 exceeds the holding force F4, the lever 9 moves to the left causing the lever 7 rotates about the pivot 8. The combined rotation is clockwise about the pivot 8. This will cause the latch 6 to disengage and release the first pin 1*a* of the armature 1. This, in turn, results in the rotation of the armature 1 due to a torque which is determined by the trip spring force F3 times the eccentricity e. The trip spring 24 will be discharged, thereby activating the latch bar 26 of the circuit breaker.

Any inertia of the solenoid plunger 10*a*, and the levers 9 and 7 towards the lever 5 that could damage the switch 17 is arrested by the adjustable stop screw 16 mounted on the bracket 15.

As soon as the armature 1 is disengaged from the lever 5, the light return spring 13 (return spring force F2) resets the solenoid plunger 10*a* and all the levers 5, 7, 9 to their normal positions. The lever 9 is coupled to and rotatable with the lever 7 about the pivot 8*a* to allow a free axial movement of the solenoid plunger 10*a*.

The eccentricity e of the cable 3 with the center line of the armature 1 can be selected to minimize the impact on the latch 6 and to provide adequate control of the motor cut-off. The flexible push-pull cable 3 allows mounting of the parts of the mechanism on the base plate P at a convenient location in the circuit breaker.

Some important details of the operation of the undervoltage release device will briefly be stressed again: It is assumed that in the tripped position of the device (see FIG. 1) the control voltage reaches its normal value after a short time. This causes the motor 2 to be energized. The drive bar 4 (which is locked on the motor shaft 2*a*) picks up the armature 1 to pull the cable 3 and charge the trip spring 24. As the armature 1 turns, its first pin 1*a* pushes the lever 5 to charge the coil spring 11, thereby counteracting the holding force F4 of the solenoid 10 on the plunger 10*a*. When the cable 3 crosses over the center of the motor shaft 2*a*, the cut-off of the switch 17 is activated by the lever 5 and its end plate 5*e* to de-energize the motor 2. The torque on the armature 1 caused by the trip spring 24 reverses in direction making the armature 1 rotate freely until it latches on the latch plate 6. The driving device of the undervoltage release device has arrived in its stand-by position.

When the control voltage drops down, the holding force F4 of the solenoid 10 on its plunger 10*a* drops proportionally. The plunger 10*a* is released when the spring force F1 exceeds the holding force F4. When this occurs, the first pin 1*a* of the armature 1 is released by the latch 6 causing it to rotate freely, and the energy stored in the spring 24 is dumped on the latch bar 26 to open the circuit breaker.

Figure 6:
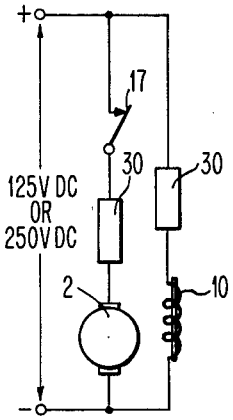
FIG. 6 is a schematic diagram of a circuit showing the electrical connections for the undervoltage release device for direct current.
Figure 7:
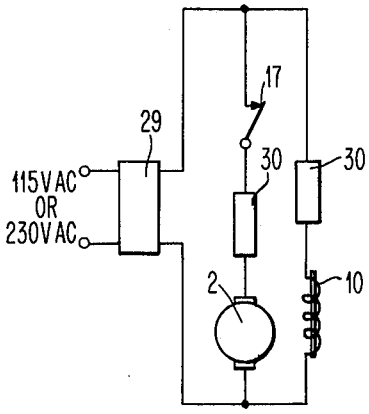
FIG. 7 is a schematic diagram of a circuit showing the electrical connections for the undervoltage release device for alternating current.

FIGS. 6 and 7 schematically show the circuits for DC and AC operation, respectively, of the undervoltage release device according to the invention. As noted, control voltages of 125 V DC, 250 V DC, 115 V AC and 230 V AC may be used. Since the circuit is basically designed for 125 V DC, a rectifier 29 is used when the device is applied on 115 V AC and 230 V AC and dropping resistors 30 are used on 250 V DC and 230 V AC.

It should be borne in mind that the undervoltage release device according to the invention is primarily intended for use as an ancillary device to trip a circuit breaker when the control voltage of the breaker drops below the operating range of the trip solenoid (solenoid 29 in FIG. 2). The device according to the invention operates in parallel with the trip solenoid both electrically and mechanically. After the tripping operation, the device resets automatically when the control voltage returns to normal. The normal drop-out range of the device may be 30 to 60% of the nominal control voltage; however, the actual drop-out may be in the 20 to 40% range due to the spurious effect of the shock and vibration of the breaker operation on the device. Similarly, the actual pick-up range may be 70 to 85% of the nominal control voltage with the normal pick-up range of 60 to 100%.

While the forms of the undervoltage release device herein described constitute preferred embodiments of the invention, it is to be understood that the invention is not limited to these precise forms of assembly, and that a variety of changes may be made therein without departing from the scope of the invention.

What is claimed is:

1. An undervoltage release device for a circuit breaker, comprising:

(a) a solenoid for sensing and undervoltage, said solenoid having a plunger and exercising a holding force on said plunger when energized by a control voltage, said plunger being movable between an attacted position in the presence of said control voltage and a released position in the presence of an undervoltage condition;

(b) a trip spring for storing energy and for discharging said energy for tripping said circuit breaker;

(c) an electric charging motor;

(d) means for coupling said motor to a source of electric current;

(e) driving means operably coupled to said charging motor, said driving means upon rotation of said motor being moved by said motor from a tripped position towards a stand-by position;

(f) connection means mechanically coupling said trip spring to said driving means for charging said trip spring in response to movement of said drive means;

(g) movable blocking means for stopping and holding said driving means in said stand-by position;

(h) a coil spring coupled between said plunger and said driving means, said coil spring being charged by movement of said driving means to said stand-by position in counteraction to the holding force of said plunger; and (i) releasing means coupled to said plunger and movable thereby from a first position to a second position for moving said blocking device to thereby release said driving means from its stand-by position;

whereby movement of said plunger from said attracted position to said released position frees said driving means from its stand-by position, thereby releasing said trip spring.

2. The undervoltage release according to claim 1, wherein said connecting means moves said driving means from said stand-by position to said tripped position by the force of said precharged trip spring, when said blocking device is acted upon by said releasing means.

3. An undervoltage release device according to claim 1, further comprising a pivoted latch bar for opening said breaker; said connecting means comprising a trip pin, said trip pin moving away from said latch bar when said drive means is in a stand-by position, said trip spring urging said trip pin against said latch bar to move said latch bar to a breaker-opening position when said blocking device is released.

4. The undervoltage release device according to claim 3, wherein said trip pin and said trip spring are located at a distance from other parts of said undervoltage release device.

5. The undervoltage release device according to claim 4, wherein said circuit breaker comprises a regular trip solenoid, and wherein said trip pin and said trip spring are located so as to apply a force to said latch bar in parallel with said regular trip solenoid.

6. The undervoltage release device according to claim 3, further comprising a cable having its one end operatively connected to said trip spring and said trip pin and having its other end operatively connected to said driving means.

7. The undervoltage release device according to claim 6, wherein said driving means comprises a crank drive including:

(a) a crankshaft operatively connected to the driving shaft of said charging motor; and (b) a crank arm having an inner portion attached to said crankshaft and having an outer portion operatively connected to said other end of said cable.

8. The undervoltage release device according to claim 7, wherein said blocking means comprise means for blocking said outer portion of said crank arm in said stand-by position when said cable has crossed over the center line of said crankshaft and the torque applied to said crank arm by the charging force of said trip spring has reversed in direction.

9. The undervoltage release device according to claim 7, wherein said inner portion of said crank arm is directly attached to the driving shaft of said charging motor.

10. The undervoltage release device according to claim 1, wherein said driving means comprise charging means for charging said coil spring into an equilibrium position when said control voltage has a normal voltage value and when said driving means are moving from said tripped position to said stand-by position.

11. The undervoltage release device according to claim 10, wherein said charging means for said coil spring comprise a charging pivot drive including:

(a) a pivot; and (b) swinging lever means having an inner end portion pivotly connected to said pivot and an outer end portion operatively connected to said other end of said coil spring, said swinging lever means being in a first swinging end position when the spring force of said coil spring keeps said plunger in its attracted position due to a normal voltage value of said control voltage, and said swinging lever means being in a second swinging end position when said driving means are in said tripped position.

12. The undervoltage release device according to claim 11, wherein said driving means comprise a crank drive for engaging and pushing said outer end portion of said swinging lever into said first swinging end position, said outer end portion swinging back into said second swinging end position when being discharged from said crank drive.

13. The undervoltage release device according to claim 11, wherein said driving means comprise a crank drive having a crankshaft and a crank arm, and wherein said pivot is arranged parallel to said crankshaft.

14. The undervoltage release device according to claim 1, further comprising switching means for energizing and de-energizing said charging motor, said switching means being actuated by said driving means.

15. The undervoltage release device according to claim 1, further comprising switching means for de-energizing said charging motor when said driving means is in said stand-by position and for energizing said charging motor when said driving means are in said tripped position.

16. The undervoltage release device according to claim 11, further comprising switching means for energizing and de-energizing said charging motor, wherein said switching means are engaged by said swinging of said charging pivot drive lever in said first swinging end position.

17. The undervoltage release device according to claim 1, wherein said blocking device comprises a blocking pivot drive including:

(a) a pivot axis;

(b) a swinging latch lever comprising:

(ba) an inner end portion pivotly connected to said pivot axis;

(bb) an outer swinging end portion operatively connected to said plunger; and (bc) a latch plate for blocking said driving means in said stand-by position; said swinging latch lever being in a first swinging end position when the spring force of said coil spring attains an equilibrium position against the solenoid holding force of said plunger under normal voltage, and said swinging latch lever being in a second swinging end position when the solenoid holding force of said plunger decreases in case of undervoltage and said driving means are in said tripped position.

18. The undervoltage release device according to claim 17, wherein said driving means comprise a crank drive having a crankshaft and a crank arm, and wherein said pivot axis is arranged parallel to said crankshaft.

19. The undervoltage release device according to claim 18, wherein said driving means further comprise a pivot drive including a pivot and swinging lever means, and wherein said latch plate is firmly connected to said swinging lever such that said crank arm of said crank drive rests on said latch plate in said first swinging end-position of said swinging lever and that said latch plate is released from said crank arm when said force of said coil spring exceeds the solenoid holding force of said plunger in case of undervoltage.

20. The undervoltage release device according to claim 19, wherein said crank drive is arranged such that the tip of said crank arm rests on said latch plate in said stand-by position.

21. An undervoltage release device according to claim 20, wherein the surface of said latch plate is concentric with respect to said pivot of said swinging lever means, such that the line of action of force of said latch plate passes through the center of said pivot.

22. The undervoltage release device according to claim 17, wherein said blocking device further comprises a transmitting lever, one end of said transmitting lever being hinge-coupled to said plunger and the other end of said transmitting lever being hinge-coupled to said outer swinging end portion of said swinging latch lever, such that a free axial movement of said solenoid plunger is possible when said swinging latch lever moves from said first end-position to said second end-position, or vice-versa.

23. The undervoltage release device according to claim 17, wherein said blocking device comprises a blocking pivot drive having a pivot axis and a swinging latch lever, and wherein the pivot axis of said charging pivot drive and said pivot axis of said blocking pivot drive are the same.

24. The undervoltage release device according to claim 23, further comprising a return-spring for resetting said solenoid plunger from its released position when undervoltage prevails into its attracted position when the normal voltage value prevails, and for resetting said outer end portion of said swinging lever means and of said swinging latch lever into said second swinging end position.

25. The undervoltage release device according to claim 24, wherein said solenoid is connected to a base plate, and wherein said return-spring is connected between said end portion of said lever means and said base plate.

* * * * *